US008496424B2

(12) United States Patent
Yrjö

(10) Patent No.: US 8,496,424 B2
(45) Date of Patent: Jul. 30, 2013

(54) FIXING ARRANGEMENT FOR A WORK PIECE

(75) Inventor: Raunisto Yrjö, Hämeenlinna (FI)

(73) Assignee: Kinshofer GmbH, Waakirchen (DE)

( * ) Notice: Subject to any disclaimer, the term of this patent is extended or adjusted under 35 U.S.C. 154(b) by 751 days.

(21) Appl. No.: 12/689,569

(22) Filed: Jan. 19, 2010

(65) Prior Publication Data

US 2011/0020102 A1 Jan. 27, 2011

(30) Foreign Application Priority Data

Jan. 19, 2009 (FI) ..... 2009-0015

(51) Int. Cl.

| | |
|---|---|
| ***E02F 3/32*** | (2006.01) |
| ***E02F 3/34*** | (2006.01) |
| ***E02F 3/36*** | (2006.01) |
| ***E02F 3/38*** | (2006.01) |

(52) U.S. Cl.

USPC ..... 414/723; 37/468; 172/272; 172/273; 172/275

(58) Field of Classification Search

USPC ..... 414/723; 403/321; 172/272, 273, 172/275; 37/468

See application file for complete search history.

(56) References Cited

U.S. PATENT DOCUMENTS

| | | | | | |
|---|---|---|---|---|---|
| 2,963,183 | A | * | 12/1960 | Przybylski | 414/723 |
| 4,436,477 | A | * | 3/1984 | Lenertz et al. | 414/723 |
| 4,906,161 | A | * | 3/1990 | Weyer | 414/705 |
| 4,948,328 | A | * | 8/1990 | Busch | 414/723 |
| 4,958,981 | A | * | 9/1990 | Uchihashi | 414/694 |
| 5,515,626 | A | * | 5/1996 | Holscher | 37/468 |
| 6,146,082 | A | * | 11/2000 | York | 414/723 |

FOREIGN PATENT DOCUMENTS

| | | | |
|---|---|---|---|
| DE | 1142320 | | 1/1963 |
| DE | 4208245 | | 9/1993 |
| DE | 4208245 | A1 * | 9/1993 |
| DE | 20116666 | | 2/2003 |
| DE | 102005045709 | | 3/2007 |
| EP | 0479747 | | 4/1992 |
| FR | 2067573 | | 8/1971 |
| FR | 2530701 | | 1/1984 |
| WO | 2007/097698 | | 8/2007 |

* cited by examiner

*Primary Examiner* — Scott Lowe
(74) *Attorney, Agent, or Firm* — Dilworth & Barrese, LLP.

(57) ABSTRACT

An arrangement for fixing a work piece (14) to an end of a boom (1) in a working machine, like an excavator, in which arrangement the end of the boom comprises at least a tilting device (13) for the work piece (14), the moveable body of said device can be limitedly tilted in relation to the end of the boom (1) and to the moveable body of said device the work piece (14) is fixed either directly or by fitting a device (10), (11) of an other type as a distance piece, said device adjusting position of the work piece (14). An auxiliary body (9) is mounted between the pins (5), (6) of the articulation points locating in the ends of the tilting device (13) and the boom (1), to said auxiliary body the tilting device (13) is fixed from both ends of its non-rotating part essentially in a point of the axis line (15) which is rotating axis (15) of the tilting part of the tilting device (13) and that for getting the fixing point of the work piece (14) nearer the articulating pin (5) in the boom (1) end, the counter articulating point (17) which is placed in the auxiliary body (9) and which can be coupled to the articulating pin (5) in the boom (1) end is fitted to pass the axis line (15) and to extend towards the work piece (14).

13 Claims, 1 Drawing Sheet

FIXING ARRANGEMENT FOR A WORK PIECE

The invention relates to an arrangement for fixing a work piece to an end of a boom in a working machine, like an excavator, in which arrangement the end of the boom comprises at least a tilting device for the work piece, the moveable body of said device can be limitedly tilted in relation to the end of the boom and to the moveable body of said device the work piece is fixed either directly or by fitting a device of another type as an intermediary piece, said device adjusting position of the work piece.

To the end of a boom of an excavator is nowadays coupled at least a tilting device in connection with a bucket or other possible work pieces and, in addition a rotating device for the bucket is often still coupled to the boom end. When these devices are first coupled to the boom end and after these the bucket is coupled to the outest one of these devices, the distance from the bucket tip to the fixing pin in the boom end increases very much even 600 mm due to these additional devices. This increase of the distance will remarkably weaken the breaking strain of the bucket tip compared to such a bucket which is directly fixed to the boom end. If the distance from the fixing point of a usual bucket tip is 1200 mm and with the above mentioned additional devices said distance increases to the length 1800 mm, the breaking starin of the bucket decreases with third part. When the dimensions of the bucket cannot be changed, the distance increase due to the additional devices has to be diminished.

In the present invention the problem which is caused by the decrease of breaking strain in the bucket tip is solved and by means of a new fixing arrangement essential improvement concerning the diminishing of the breaking strain of the bucket caused by additional devices is achieved. Characteristics for the invention according to the invention is that an auxiliary body is mounted between the pins of the articulated points locating in the ends of the tilting device and the boom, to said auxiliary body the tilting device is fixed from both ends of its non-rotating part essentially in a point of the axis line which is turning axis of the tilting part of the tilting device and that for getting the fixing point of the work piece nearer the articulating pin in the boom end, the counter articulating point which is placed in the auxiliary body and which can be coupled to the articulating pin in the boom end is fitted to pass the axis line and to extend towards the work piece.

Advantageous for the arrangement according to invention is that the articulating point of the turning motion of the work piece, like bucket can be got very close to the bucket in spite of the fact that to the end of the boom are first fixed one or more additional devices realizing different motions.

When the articulating point locates close to the bucket, a great turning force is obtained to turn the bucket and especially great breaking strain to the bucket tip. In the known solutions the articulating point in the boom end, around which the bucket is turned, must be remounted in the body of the additional device which is first fixed to the boom end. All additional devices have only increased the distance from the fixing point in the boom end to the work piece. The invention is applicable for use in connection with the bucket and its additional devices either when only tilting device is used or when tilting device and rotating device is used.

In the following the invention is closely described referring to enclosed drawings where FIG. 1 shows an end of a boom in an excavator and an auxiliary body therein realizing an embodiment according to the invention.

Figure 1:
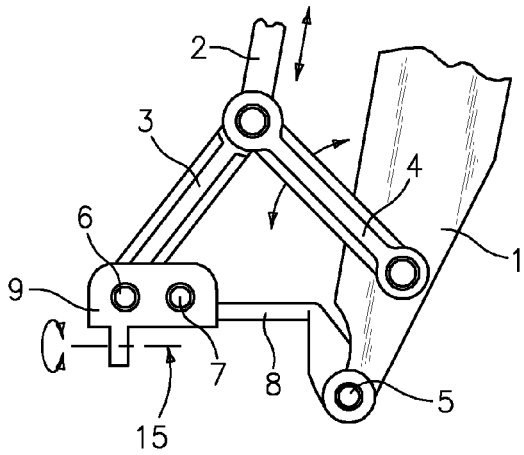

In FIG. 1 a usual boom 1 end of an excavator is shown, said end comprising an articulated fixing point for a work piece, into which point generally a pin 5 is pushed wherein said pin is, allowing turning, locking the pieces fixed to said point. By means of a hydraulic cylinder 2 motion is lead to arms 3 and 4 which arms are moving the other fixing point 6 for the work piece, which motion is turning the work piece, like a bucket 14. In this case the boom end first comprises an auxiliary body 9, which is coupled to the boom 1 end by means of said articulated points and pins 5 and 6.

Figure 2:
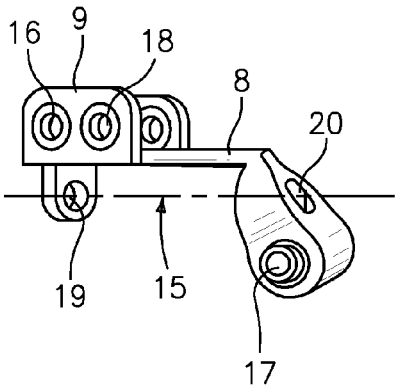
FIG. 2 shows an auxiliary body seen from inclined view.

FIG. 2 shows closely an auxiliary body 9, which comprises two alternative fixing points 16 and 18 for the arm 3 on its upper side and on its lower side in the lower edge of an downwards directed protruding part an articulating point 17, as a hole and into said hole fitted pin. The auxiliary body comprises a distance piece 8 which is connecting with articulating points equipped body 9 ends to each other. In this embodiment the auxiliary body comprises holes 19 and 20 in the axis line 15 for fixing an additional device, like tilting device to this auxiliary body 9 by means of these holes. In a preferred embodiment the holes 19 and 20 are for example grooved, wherein the shaft pins extending out from the tilting device are grooved respectively and thus non-rotating in relation to the auxiliary body 9. The other outer body part of the tilting device turns respectively, when it is making tilting operation.

Figure 3:
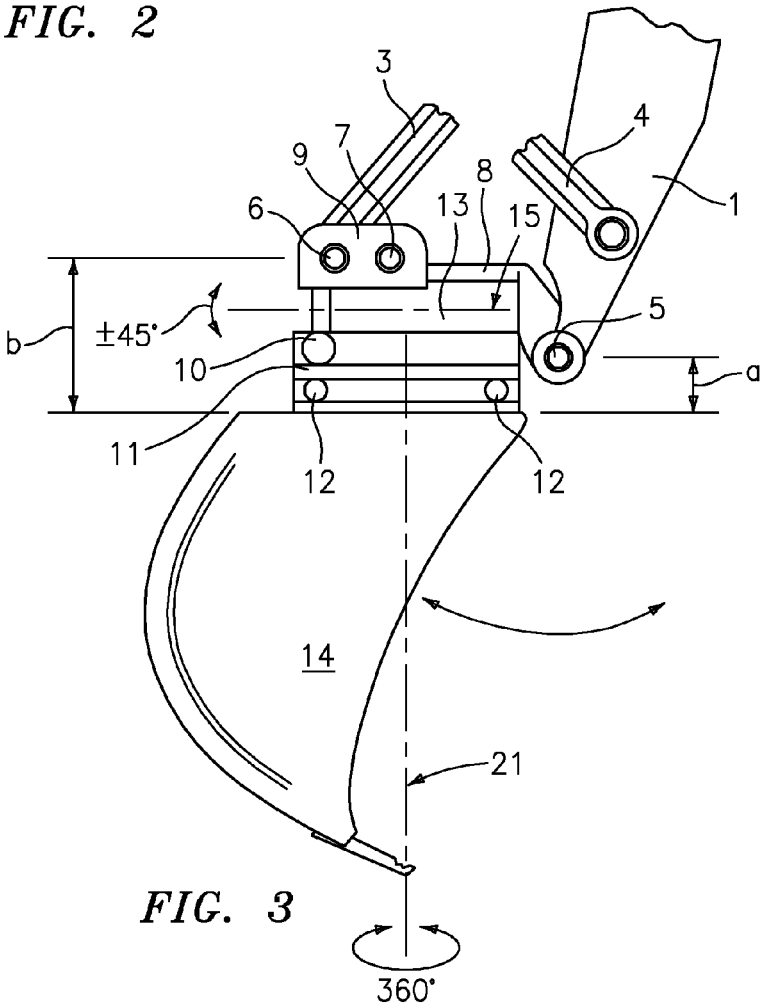
FIG. 3 shows an end of a boom and an auxiliary body, tilting device and bucket fixed thereto.

In FIG. 3 is shown a tilting device 13 fixed as first to the auxiliary body 9, the outer body part of it being rotatable and realizes tilting and respectively shaft pins in the both ends of the body are placed non-rotatable into holes 19 and 20 in the auxiliary body and thus transferring supporting force to the auxiliary body. The outer body of the tilting device 13 turns in a known way limitedly to both directions for example by means of hydraulic pressure acting converter device, where axial motion of a hydraulic cylinder is changed to rotation motion.

To the outer tilting body of the tilting device 13 has been further coupled a rotation device 11 comprising a hydraulic motor 10 by means of which in a known way that body part of the rotation device, which locates on the bucket 14 side is rotated, and to which body part the bucket 14 is fixed for example by means of pins 12. The bucket 14 is thus rotated around the axis line 21.

It can be seen from the FIG. 3 that the articulation point and pin 5 of the boom end locates thanks to the auxiliary body 9 at the distance only a from the bucket. In the known constructions the articulating point and pin 5 of the boom 1 end locates on the same level as articulating point and pin 6 or the alternative articulating point 13 i.e. at the distance b from the bucket. By means of the invention a surprising advantage is achieved when the additional devices 13 and/or 10 coupled to the boom end do not increase the distance from the articulating point 5 to the bucket 14 to the distance b as the known solutions but essentially less, only to the distance a.

The distance a is easily arranged by means of the auxiliary body so that it is below half of the distance b. This distance has very remarkable influence to the breaking strain produced in the bucket tip. In the solution according to the invention the distance from the articulating point and pin 5 to the bucket 14 tip when additional devices are used increases very little, for example only 20-40% of that increase which is produced when using additional devices in the known solutions.

The tilting device 13 can be coupled by means of other ways to the auxiliary body 9, but however, said device has always an axis line 15 for tilting or limited turning, which line can be arranged always so that the articulating point 5 locates between the bucket 14 and it.

The invention claimed is:

1. An arrangement for fixing a work piece (14) to an end of a boom (1) in a working machine and comprising:

a boom (1) having an articulation pin (5) defining a first rotation axis about which the work piece (14) is swivellable;

actuation means (2, 3, 4) for swiveling the work piece (14) about the first rotation axis defined by said articulation pin (5) on the boom (1);

said actuation means comprising a coupling pin (6) defining a further point for fixing and swiveling the work piece (14) about said articulation point (5) on the boom (1);

a device (13) for tilting the work piece (14) about a second axis (15) lying substantially perpendicular to the first rotation axis defined by said articulation pin (5) and lying substantially parallel to a plane through pins (12) on said tilting device (13) for fixing the work piece (14) to said tilting device (13);

said tilting device (13) further comprising a movable body to which the work piece (14) is attachable either directly or by a distance piece (10, 11), such that the distance piece (10, 11) adjusts position of the work piece (14) with respect to a third axis (21) substantially perpendicular to both said first (5) and second (15) axes, the movable body of the tilting device (13) being limitedly tiltable about said second axis (15) relative to the boom (1);

an auxiliary body (9) mounted between said articulation pin (5) and coupling pin (6) and upon said articulation pin (5) at a counter-articulating point (17), with said tilting device (13) being fixed at both ends by a non-rotating part thereof to said auxiliary body (9) and fixing points at ends of said tilting device (13) defining said second axis (15); and said counter articulation point (17) coupled to said articulation pin (5) of the boom (1) being located at a side of said second axis (15) lying closer to the work piece (14), to reduce distance (a) between said articulation pin (5) and the work piece (14).

2. The arrangement according to claim 1, wherein the distance piece (10, 11) is mounted between the tilting device (13) and the work piece (14).

3. The arrangement according to claim 1, additionally comprising a second articulation point (16) located upon said auxiliary body (9), wherein the counter-articulation and second articulation points (17, 16) are located on different sides of said second axis (15) of the tilting device (13) from one another.

4. The arrangement according to claim 3, wherein said auxiliary body (9) comprises an alternative fixing point (18) to said second articulation point (16).

5. The arrangement according to claim 4, wherein said second articulation point (16) and alternative fixing point (18) are both located on a different side of said second axis (15) of the tilting device (13) from said counter-articulating point (17).

6. The arrangement according to claim 3, wherein the distance (a) of said counter articulating point (17) from the work piece (14) is arranged to be less than one half distance (b) of the second articulation point (16) from the work piece (14).

7. The arrangement according to claim 1, wherein said auxiliary body (9) comprises a downwardly-protruding edge upon which said counter articulating point (17) is situated.

8. The arrangement according to claim 1, additionally comprising non-rotatable holes (19) and (20) formed in said auxiliary body (9), for receiving shaft pins extending from ends of the tilting device (13) to couple the tilting device (13) thereto.

9. The arrangement according to claim 8, wherein said holes (19, 20) are oriented along said second axis (15).

10. The arrangement according to claim 1, wherein said distance piece (10, 11) is arranged to swivel the work piece (14) around said third axis (21) in a 360° direction.

11. The arrangement according to claim 10, wherein said distance piece (10, 11) comprises a rotation device (11) arranged to be coupled to the work piece (14) and a hydraulic motor (10) coupled to the rotation device (11).

12. The arrangement according to claim 1, wherein said tilting device (13) is arranged to pivot the work piece (14) up to about ±45° around said second rotation axis (15).

13. The arrangement according to claim 1, wherein said auxiliary body (9) is shaped and configured such that said counter articulating point (17) is always located between said second axis (15) and the work piece (14).

* * * * *